US006526852B2

(12) United States Patent
Rahmsdorf et al.

(10) Patent No.: US 6,526,852 B2
(45) Date of Patent: Mar. 4, 2003

(54) SCREW DRIVING TOOL

(75) Inventors: Horst Rahmsdorf, Munich (DE); Thomas Hofbrucker, Mammendorf (DE); Markus Looser, Weilheim (DE); Thomas Bader, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/898,391

(22) Filed: Jul. 3, 2001

(65) Prior Publication Data

US 2002/0002883 A1 Jan. 10, 2002

(30) Foreign Application Priority Data

Jul. 6, 2000 (DE) ..... 100 32 949

(51) Int. Cl.[7] ..... B25B 19/00
(52) U.S. Cl. ..... 81/464; 173/117
(58) Field of Search ..... 81/463–466, 473–475; 173/93.7, 117, 114, 201

(56) References Cited

U.S. PATENT DOCUMENTS 3,550,243 A * 12/1970 Allsop ..... 81/464
3,584,695 A * 6/1971 Turnbull ..... 173/107
4,370,906 A 2/1983 Gurries
5,497,555 A * 3/1996 Averbukh ..... 173/117
5,775,440 A * 7/1998 Shinma ..... 173/201
6,035,945 A * 3/2000 Ichijyou et al. ..... 173/201
6,109,149 A * 8/2000 Neumaier ..... 81/474
2002/0014344 A1 * 2/2002 Geiger et al. ..... 173/114

FOREIGN PATENT DOCUMENTS

DE 1478914 * 11/1969
GB 1187585 4/1970

* cited by examiner

*Primary Examiner*—D. S. Meislin
(74) *Attorney, Agent, or Firm*—Sidley Austin Brown & Wood, LLP

(57) ABSTRACT

A screw driving tool including a housing (1), a hollow spindle (3) rotatably supported in the housing (1) with a possibility of a limited axial displacement relative thereto, a screw-in spindle 5 at least partially extending in the hollow cylinder (3), connected thereto for joint rotation therewith, and supported for a limited axial displacement relative thereto, an impact mass (15) for displacing the screw-in-spindle (5) in a screw-in direction, a drive motor (2) for rotating the screw-in spindle (5), and a clutch (6) located between the hollow spindle (3) and the drive motor output shaft (19) for transmitting rotational movement to the hollow spindle (3).

8 Claims, 1 Drawing Sheet

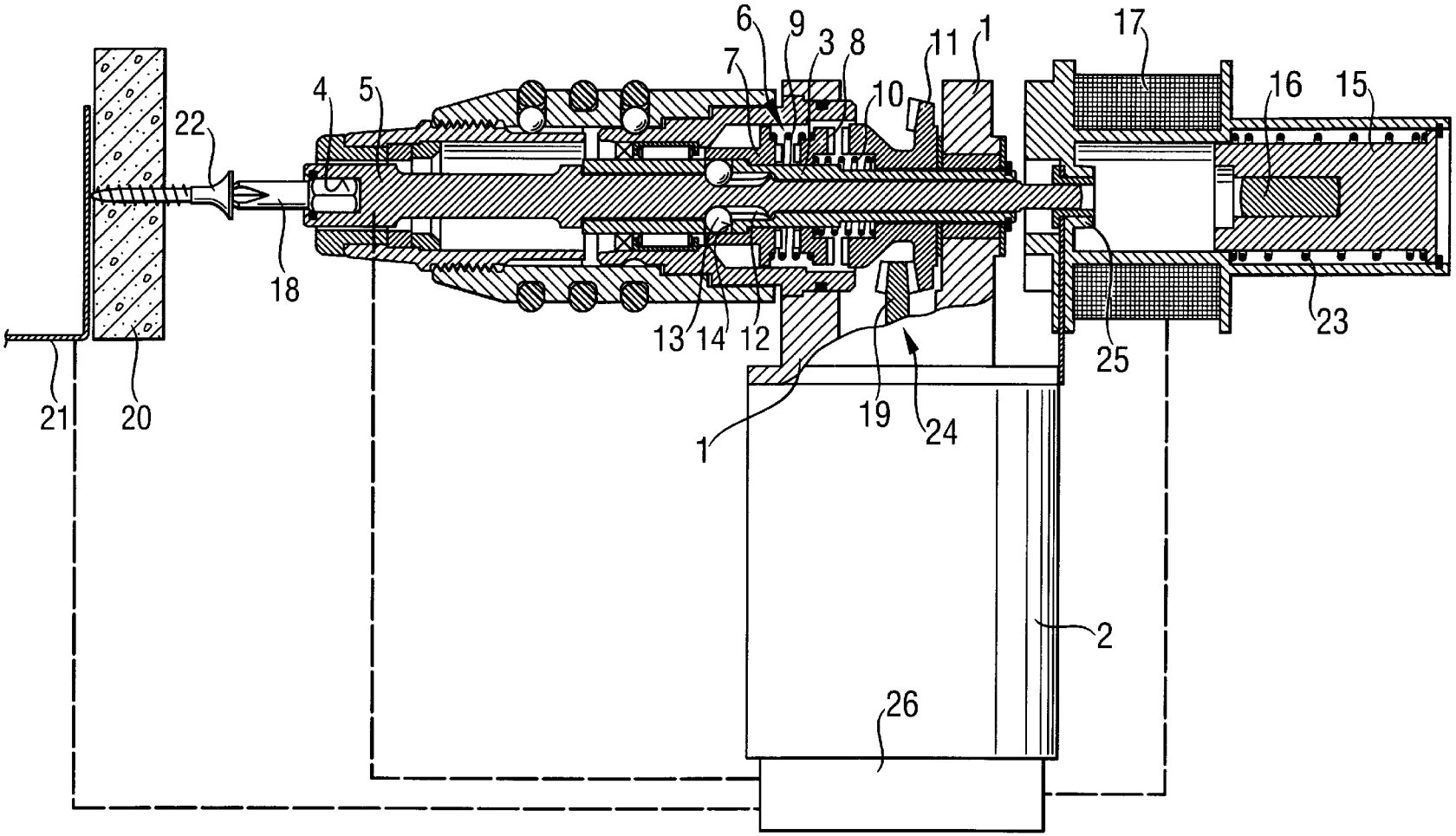
15
16
17
23
25
2
1
11
10
8
3
9
6
7
24
19
26
12
14
13
1
5
4
18
22
20
21

SCREW DRIVING TOOL

BACKGROUND OF THE INVENTION

1. Field of the Invention

The present invention relates to a screw driving tool including a housing, a hollow spindle rotatably supported in the housing, a screw-in spindle at least partially extending in the hollow spindle and supported for a limited axial displacement relative thereto, an impact mass supported in the housing for a limited axial displacement therein for displacing the screw-in-spindle in a screw-in direction, and a drive motor for rotating the screw-in spindle.

2. Description of the Prior Art

At present, for dividing a space in a structure, partition walls are used. A partial wall is formed of a sheet metal frame to the opposite sides of which gypsum plasterboards are secured with rapid screw-in screws having sharp tips. The advantage of using such screws consists in that they can form, upon being screwed-in, a bore in the sheet metal frame the wall of which is engaged by the threaded section of a screw. However, when these screws are screwed in with conventional screw driving tools, a user needs to apply a rather high press-on force to the tool.

German Patent No. 1,478,914 discloses a pneumatically driven screw driving tool which permits to reduce the press-on force that needs to be applied. The disclosed tool has a screw-in spindle displaceable relative to the tool housing in a direction opposite to the screw-in direction against a biasing force of a spring. A clutch, which is located between the screw-in spindle and a hollow spindle driven by the tool drive motor, connects the screw-in spindle with the hollow spindle to provide for their joint rotation when the screw driving tool is pressed against a constructional component. The clutch becomes engaged as a result of displacement of the screw-in spindle toward the hollow spindle.

When a gypsum plasterboard is secured to a sheet metal frame, the screw-in spindle is driven by the tool drive motor as a result of the screw-in spindle being connected with the hollow spindle, and the rapid screw-in screw (further simply screw) is drilled through the plasterboard until the screw tip contacts the surface of the sheet metal frame. Finally, an accelerated in the screw-in direction, impacts mass impacts the screw-in spindle. The screw-in spindle is accelerated in the screw-in direction, and the screw tips forms a bore in the sheet metal frame into which the screw is driven-in. Because the connection between the screw-in spindle and the hollow spindle breaks upon the axial displacement of the screw-in spindle, the screw is displaced axially, without being rotated. The screw thread expands the bore in the sheet metal frame to such an extent that with a subsequent screw-in step, the remaining portion of the screw thread cannot form a matching screw in the bore wall, and the screw is stopped.

Compressed air, which is necessary for driving the known pneumatically driven screw driving tool is fed from an external compressor and, e.g., can be stored in a likewise external compressed air container. The external arrangement of the compressor or the compressed air container requires use of a compressed air hose which makes the handling of the screw driving tool much more difficult.

Accordingly, an object of the present invention is to provide a manually operated screw driving tool that would insure a high quality screw fitting in the sheet metal frame.

Another object of the present invention is to provide a manually operated screw driving tool that would require an application of a substantially reduced press-on force.

A further object of the present invention is to provide a manually operated screw driving tool in which the displacement of the screw-in spindle in the screw-in direction as a result of a impact applied thereto by the impact mass is not accompanied by rotational disengagement of the screw-in spindle from the hollow spindle.

SUMMARY OF THE INVENTION

These and other objects of the present invention, which will become apparent hereinafter are achieved by providing a screw driving took in which the hollow spindle is rotatably supported in the tool housing with a possibility of a limited axial displacement relative thereto, and a clutch is located between the hollow spindle and the drive motor output shaft for transmitting rotational movement to the hollow spindle and thereby to the screw-in spindle.

In the screw driving tool according to the present invention, the rotational movement is transmitted from the drive motor to the screw-in spindle via the hollow spindle which is supported in the tool housing with a possibility of a limited axial displacement. Because the hollow spindle is axially displaceable, it is possible to impact the screw-in spindle as it rotates, together with the hollow spindle, i.e., without breaking the rotational connection of the screw-in spindle with the hollow spindle. The screw forms a bore in the sheet material frame, and the screw thread forms a matching thread in the bore wall, with the screw being reliably retained in the bore.

A particularly reliable and strong rotational connection between the hollow spindle and the screw-in spindle is advantageously obtained by using at least one ball-shaped locking member received in a radial bore provided in the hollow spindle and projecting into a groove formed in the screw-in spindle.

An automatic displacement of the hollow spindle in the screw-in direction to its initial position and the release of the rotational connection between the hollow spindle and the output shaft of the drive motor is effected by at least one spring of the clutch upon lifting of the screw driving tool off the gypsum plasterboard.

A particularly compact structure of the screw driving tool, in particular with respect to its length, is obtained with, advantageously, the hollow spindle extending through the clutch and through a tooth gear which transmits the rotational movement of the output shaft of the drive motor to the hollow spindle.

For manufacturing and assembly reasons, preferably, the hollow cylinder is fixedly connected with first, screw-in direction side, member of the clutch and is displaceable against a biasing force of the first clutch spring, in the direction opposite the screw-in direction, toward a second, freely rotatable and axially displaceable relative to the hollow spindle, member of the clutch. The second member is also displaceable in the direction opposite the screw-in direction against a biasing force of a second spring into engagement with a tooth gear that transmits the rotational movement of the output shaft of the drive motor to the hollow spindle. Because the components of the clutch and the rotational movement transmitting gear are all located in the immediate vicinity of the hollow spindle, the clutch, the gear, and the hollow cylinder, together with the screw-in spindle, can be formed as a pre-fabricated unit and inserted, during the assembly of the screw driving tool, into the tool housing in a single step.

Advantageously, the impact mass, which advances the screw-in spindle in the screw-in direction, is accelerated in this direction by an electromagnet. The electromagnet permits to obtain uniform impacts which positively influences the quality of the screw connection.

The impact mass, e.g., can be formed of at least two coaxial, separate impact masses, with the screw-in direction side, first impact mass being formed of a non-magnetizable material, and the second mass being formed of a magnetizable material. The magnetizable impact mass is not permanently magnetized but rather remains magnetized as long as the magnet coil remains under tension. The impact mass, however, can be formed as a piston displaceable in a cylinder in an operational direction, against a biasing force of a spring, under a fluid, e.g., air pressure applied thereto. It is, however, possible to have the pressure applied for displacing the piston in a direction opposite the operational or screw-in direction. In this case, the piston pre-loads a spring that would accelerate the piston in the operational direction at a determined point of time.

To avoid dependence on an external pressure source, the air pressure can be obtained, e.g., form a compressor connected with the tool housing. The compressor can be driven, e.g., by the electric motor of the tool. This means that the compressor, the necessary valves and, if necessary, compressed air container should be provided on the housing of the screw driving tool or be built-in in the housing. The impact energy can be determined, e.g., by adjusting the pressure applied to the piston.

Advantageously, the displacement of the impact mass can be controlled by an electronic element electrically connected with the screw or the screw-in spindle and with the constructional component, e.g., a sheet metal frame. Upon the screw contacting the constructional component, the electronic element generates a control signal for actuating the electromagnet. The control or actuation signal can be produced, e.g., as a result of a comparison measurement of the capacity of the system screw-in spindle, screw bit, screw.

An automatic acceleration of the impact mass in the screw-in direction can be, e.g., achieved by monitoring the speed of the advance of the screw through the gypsum plasterboard and/or the sheet metal frame. This monitoring can be effected with, e.g., an electrical potentiometer which serves as a measurement pick-up and is connected with a displaceable depth stop. When, upon the screw encounting the sheet metal frame, the speed of the screw advance decreases, the predetermined current or voltage course for penetration through the plasterboard or frame changes. The change can be picked up by an evaluation electronics which would generate a control signal for accelerating the impact mass.

The novel features of the present invention, which are considered as characteristic for the invention, are set forth in the appended claims. The invention itself, however, both as to its construction its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawing shows a longitudinal partially cross-sectional view of a screw driving tool according to the present invention.

DETAILED DESCRIPTION OF THE PREFERRED EMBODIMENT

A screw driving tool according to the present invention, which is shown in the only figure of the drawings, includes a housing 1, an electrical drive motor 2, a hollow spindle 3 rotatably supported in the housing 1, a gear unit 24, and a clutch 6 that cooperates with the hollow spindle 3. A screw-in spindle 5, which is provided, in the end region thereof facing in the screw-in direction, with a chuck 4, is received in the hollow spindle 3 without a possibility of rotation relative thereto but with a possibility of axial displacement relative thereto. A screw driving bit 18 is inserted into the chuck 4. The bit 18 has driving surfaces adapted to a head of a screw 22. An end region of the screw-in spindle 5 remote from the chuck 4 has a rounded impact surface. Ball-shaped locking members 13 fixedly secure the screw-in spindle 5 in the hollow spindle 3 against rotation. The ball-shaped locking members 13 are located in radial receiving bores 14 of the hollow spindle 3 and extend into respective elongate slots 12 formed in the screw-in spindle 5. The drive motor 2 has an output shaft 19 which extends transverse to the screw-in direction. The gear unit 24 is formed of bevel gears.

The screw driving unit according to the present invention is used for securing gypsum plasterboards 20 to sheet metal frames 21 with screws 22 which are screwed through the plasterboards 20 in the sheet metal frames 21. In the drawing, only one screw 22, which is screwed in the plasterboard 21, is shown. The hollow spindle 3 and the clutch 6 are shown in a disengaged condition. In this condition of the clutch 6, a transmission of a rotational movement from the drive motor 2 to the screw-in spindle 5 is interrupted.

A clutch 6 which is arranged in the drive chain between the drive motor 2 and the hollow spindle 3, has a screw-in side, first clutch member 7 fixedly connected with the hollow spindle 3, and a second, axially displaceable and freely rotatable, clutch member 8. The first clutch member 7 is displaceable, against a biasing force of a first spring 9, in a direction opposite to the screw-in direction toward the second clutch member 8. The second clutch member 8 is displaceable, against a biasing force of a second spring 10, also in the direction opposite the screw-in direction, toward the gear 11 of the gear unit 24 through which the hollow spindle 3 extends. The gear 11 is drivingly connected with the output shaft 19 of the drive motor 2.

Behind the hollow spindle 3 and coaxial therewith, there is located a coil of an electromagnet 17. An impact mass 15, which is displaceable parallel to the screw-in direction and has a hardened insert 16 embedded therein, is arranged in the coil of the electromagnet 17. The hardened insert 16, which cooperates with the rounded impact surface of the screw-in spindle 5, can be formed, e.g., as a cylindrical pin. The insert 16 transmits the impact energy of the impact mass 15 to the screw-in spindle 5.

In the embodiment shown in the drawings, the impact mass 15 is retained in its initial position by a return spring 23. A major portion of the magnetizable part of the impact mass 15 is located outside of the coil of the electromagnet 17 and inside of the return spring 23.

The length of the screw-in spindle 5 is so selected that its impact surface only then can be impacted when the clutch 6 is actuated as a result of the axial displacement of the hollow spindle 3 in the direction opposite the screw-in direction. Thereby, without any additional components, application of a necessary force is insured. The energy of an idle stroke of the impact mass 15 is absorbed by a stop 25 located inside the coil. The coil of the electromagnet 17 can be controlled, e.g., by an electronic element (not shown) which, e.g., provides for feeding voltage to the coil for a predetermined time period in response to a signal generated by a sensor (also not shown) when it detects a sheet metal frame. The generated magnetic force accelerates the magnetizable impact mass 15 in the screw-in direction against the biasing force of the return spring 23.

If, at this moment, the clutch 6 is activated, the impact mass 15 would impact the screw-in spindle 5 which extends past the hollow spindle 3, transmitting its kinetic energy to the screw-in spindle 5 and, thereby, to the screw bit 18 that transmits the impact energy to the screw 22. After the impact, the impact mass 15 is returned into its initial position by the return spring 23. After the tip of the screw 22 is driven through the wall of the sheet metal frame 21, the screw-in process continues until the clutch 6 becomes disengaged.

The impact step can be triggered, e.g., automatically by a schematically shown, sensor-based electronic unit 26 in response to detection of a contact of the screw tip with a surface of the sheet metal frame 21. To this end, the electronic unit 26 should be electrically connected, with the clutch 6 being activated, with the screw-in spindle 5, the surface of the sheet metal frame 21, and the electromagnet 17. The connecting conductors are shown with the dash lines. In order to exclude any damaging influence, the screw-in spindle 5 is electronically insulated, with respect to the torque transmission, with, e.g., bearing bushes formed of a plastic material and non-conductive ceramic balls.

The electrical contact is effected by a connection with a conductive bearing sleeve.

With the disengaged clutch, the upset end of the screw-in spindle 5 provides for formation of an electrically insulating slot between the end of the bearing sleeve and the chuck. Only its axial displacement provides, with the clutch being activated, for closing of the contact, preventing additional errors and idle impacts. The sensor-based electronics is based on a comparison measurement of the capacity of the system screw-in spindle, screw bit, rapid screw-in screw with and without the sheet metal frame.

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiment within the spirit and the scope of the present invention as defined by the appended claims.

What is claimed is:

1. A screw driving tool for screwing a screw into a constructional component, comprising a housing (1); a hollow spindle (3) rotatably supported in the housing (1) having limited axial displacement relative thereto; a screw-in spindle (5) at least partially extending in the hollow spindle (3), connected thereto for joint rotation therewith and supported for a limited axial displacement relative thereto; an impact mass (15) cooperating with a surface of the screw-in spindle (5) for displacing the screw-in spindle (5) in a direction in which the screw is screwed into the constructional component; a drive motor (2) for rotating the screw-in spindle (5) and having an output shaft (19); and a clutch (6) located between the hollow spindle (3) and the drive motor output shaft (19) for transmitting rotational movement to the hollow spindle (3) and thereby to the screw-in spindle (5).

2. A screw driving tool according to claim 1, further comprising at least one ball-shaped locking member (13) for connecting the screw-in spindle (5) to the hollow spindle (3) for joint rotation therewith, the hollow spindle (3) having a radial bore (14) in which the ball-shaped locking member (13) is received, and the screw-in spindle (5) having an elongate groove (12) into which the ball-shaped locking member (13) projects.

3. A screw driving tool according to claim 1, wherein the clutch (6) includes at least one spring (9, 10), the hollow spindle (3) being displaceable in a direction opposite the screw-in direction against the biasing force of the at least one spring (9, 10) into an operational position thereof in which the hollow spindle (3) is operationally connected with the output shaft (19) of the drive motor (2), whereby the rotational movement of the output shaft (19) is transmitted to the hollow spindle (3) and thereby to the screw-in spindle(s).

4. A screw driving tool according to claim 1, wherein the hollow spindle (5) extends through the clutch (6).

5. A screw driving tool according to claim 1, further comprising a gear unit (24) for transmitting rotation of the output shaft (19) of the drive motor (2) to the hollow spindle (3) and including a tooth gear (11), the hollow spindle (3) extending through the tooth gear (11).

6. A screw driving tool according to claim 5 wherein the clutch (6) has a first member (7) fixedly connected with the hollow spindle (3), a second, freely rotatable member (8) axially displaceable relative to the hollow spindle (3), and first and second springs (9, 10) for biasing, respectively, the first and second clutch members (7, 8) in the screw-in direction, the first clutch member (7) being fixedly connected with the hollow spindle (3) and displaceable therewith against a biasing force of the first spring (9) toward the second clutch member (8), and the second clutch member (8) being displaceable against a biasing force of the second spring (10) into engagement with the tooth gear (11).

7. A screw driving tool according to claim 1, further comprising an electromagnet (17) for displacing the impact mass (15) in the screw-in direction.

8. A screw driving tool according to claim 7, further comprising electronic means for controlling displacement of the impact mass (15) and connected with one of a to-be-screwed-in screw (22) and the screw-in spindle (5) and with a constructional component into which the screw is to be screwed in, the electronic means generating, in response to the screw contacting the constructional component, a control signal for actuating the electromagnet (17), whereby the displacement of the impact mass (15) in the screw-in direction takes place.

* * * * *